US005464721A

United States Patent [19]

Yagi et al.

[11] Patent Number: 5,464,721

[45] Date of Patent: Nov. 7, 1995

[54] AMORPHOUS SILICON PHOTORECEPTOR AND ELECTROPHOTOGRAPHIC PROCESS USING THE SAME

[75] Inventors: Shigeru Yagi; Masato Ono, both of Minami-ashigara, Japan

[73] Assignee: Fuji Xerox Co., Ltd., Tokyo, Japan

[21] Appl. No.: 113,100

[22] Filed: Aug. 30, 1993

[30] Foreign Application Priority Data

Sep. 2, 1992 [JP] Japan ..... 4-257569
Sep. 2, 1992 [JP] Japan ..... 4-257572

[51] Int. Cl.[6] ..... G03G 13/02; G03G 13/22

[52] U.S. Cl. ..... 430/126; 430/902; 361/225

[58] Field of Search ..... 430/126, 902; 361/225

[56] References Cited

U.S. PATENT DOCUMENTS

| | | | |
|---|---|---|---|
| 4,409,311 | 10/1983 | Kawamura et al. | 430/95 |
| 5,008,706 | 4/1991 | Ohmori et al. | 361/225 X |
| 5,068,762 | 11/1991 | Hoshihara | 430/902 X |

FOREIGN PATENT DOCUMENTS

| | | |
|---|---|---|
| 57-179860 | 11/1982 | Japan . |
| 58-66948 | 4/1983 | Japan . |
| 59-148066 | 8/1984 | Japan . |
| 59-162562 | 9/1984 | Japan . |
| 61-182052 | 8/1986 | Japan . |
| 63-210864 | 9/1988 | Japan . |
| 64-29875 | 1/1989 | Japan . |
| 1-144072 | 6/1989 | Japan . |
| 1-43954 | 9/1989 | Japan . |
| 2-203359 | 8/1990 | Japan . |

*Primary Examiner*—Roland Martin
*Attorney, Agent, or Firm*—Oliff & Berridge

[57] ABSTRACT

A electrophotographic process for formation of an image is provided, which comprises bringing a metallic charger into contact with the surface of an amorphous silicon photoreceptor, providing a potential difference between the amorphous silicon photoreceptor and the metallic charger to charge the photoreceptor, exposing the photoreceptor to light to form an electrostatic latent image, developing the electrostatic latent image with toner particles to be attached to the surface of the photoreceptor, superimposing a transfer medium on the surface of the photoreceptor, and transferring the toner particles to the transfer medium. The process enables miniaturization of copying machine and energy saving.

22 Claims, 3 Drawing Sheets

AMORPHOUS SILICON PHOTORECEPTOR AND ELECTROPHOTOGRAPHIC PROCESS USING THE SAME

FIELD OF THE INVENTION

The present invention relates to an amorphous silicon photoreceptor and an electrophotographic process using such an amorphous silicon photoreceptor.

BACKGROUND OF THE DISCLOSURE

In the most popular electrophotography, charging is effected by means of corona discharge such as corotron and scorotron. However, the corona discharge is disadvantageous in that products due to the discharge cause image defects such as image blur and image loss and generation of ozone causes denaturation and environmental pollution. In recent years, hydrogenated amorphous silicon photoreceptors have been proposed as long-life photoreceptors having a high sensitivity and an excellent durability. However, these hydrogenated amorphous silicon photoreceptors exhibit a higher dielectric constant than selenium photoreceptors and organic photoreceptors, and thus are disadvantageous in that when charged by corona discharge, they are subject to the generation of ozone or image blur under high humidity. In order to eliminate these disadvantages, it has been proposed to employ a contact charging process such as roller charging instead of corona discharge (as disclosed in JP-A-63-210864, JP-A-64-29875, and JP-A-2-203359 (the term "JP-A" as used herein means an "unexamined published Japanese patent application")). However, this approach leaves much to be desired in charging. Further, since the hydrogenated amorphous silicon surface is hard if a rubber roller is used as a contact charger, it is subject to abrasion that causes deterioration with time. Thus, this is an unreliable charging process for long-life photoreceptors.

SUMMARY OF THE INVENTION

It is therefore an object of the present invention to provide an electrophotographic photoreceptor which can be thoroughly charged even under high humidity conditions as well as enable a prolonged stable copy operation in a contact charging process.

It is another object of the present invention to provide a highly reliable and long-life electrophotographic process which is free from generation of ozone and is adaptable to high speed operation.

It is a further object of the present invention to provide an electrophotographic process more simple than the prior art electrophotographic process and thus enabling miniaturization and energy saving.

It is a still further object of the present invention to provide an image formation process which can provide a high quality print free of image blur under high humidity conditions.

These and other objects of the present invention will become more apparent from the following detailed description and examples.

The foregoing objects of the present invention are accomplished by a process for the formation of an image, which comprises:

bringing a metallic charger into contact with the surface of an amorphous silicon photoreceptor;

providing a potential difference between said amorphous silicon photoreceptor and said metallic charger to thereby charge said photoreceptor;

exposing said photoreceptor to light to form an electrostatic latent image;

developing said electrostatic latent image with toner particles to be attached to the surface of said photoreceptor;

superimposing a transfer medium on the surface of said photoreceptor; and transferring the toner particles to said transfer medium.

The process of the present invention is preferably applied to an amorphous silicon photoreceptor comprising an electrically conductive substrate having provided thereon, in sequence, an amorphous silicon photoconductive layer, an amorphous silicon interlayer preferably having an enhanced charge trapping property, and an amorphous silicon surface layer preferably having an enhanced charge injection property.

DETAILED DESCRIPTION OF THE INVENTION

The present invention will be further described with reference to the drawings.

Figure 1:
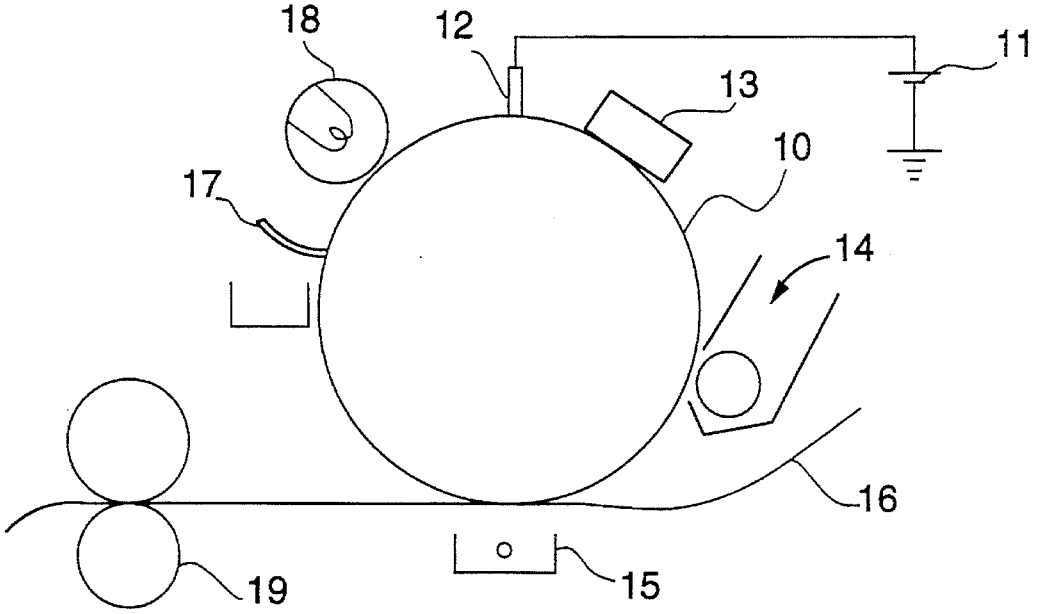
FIG. 1 is a schematic diagram of an electrophotographic apparatus practicing the process of the present invention.

The electrophotographic process of the present invention is practiced using an electrophotographic apparatus illustrated in FIG. 1. Specifically, photoreceptor 10 having a photoconductive layer mainly made of amorphous silicon is charged on the surface of the photoreceptor by means of metallic charger 12 to which a voltage has been applied from power supply 11. The photoreceptor is then imagewise exposed to light from optical system or image input apparatus 13 such as laser and LED to form an electrostatic latent image thereon. The electrostatic latent image thus formed is then visualized with a toner by means of developing machine 14 so that it is converted to a toner image. In this case, development can be effected by a magnetic brush process. The toner image thus formed is then transferred to paper 16 by means of pressure transfer or electrostatic transfer machine 15. The residual toner on the surface of the photoreceptor is then removed by means of cleaner 17 comprising a blade. The slight electric charge left on the surface of the photoreceptor is then eliminated by means of destatizing lamp 18. The toner image transferred on paper 16 is then fixed by means of fixing apparatus 19.

Figure 2:
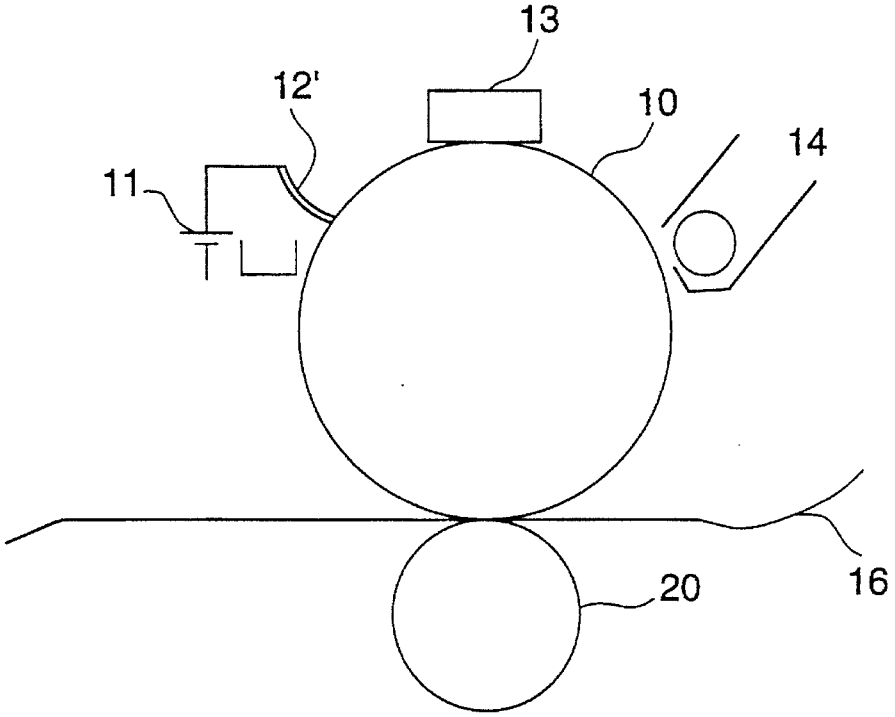
FIG. 2 is a schematic diagram of another electrophotographic apparatus practicing the process of the present invention.

FIG. 2 is a schematic diagram of another electrophotographic apparatus wherein metallic charger 12 serves also as a cleaning blade. Transfer and fixing are effected by pressing transfer-fixing roll 20 against the surface of the photoreceptor. The system is simple and thus is advantageous in miniaturization and energy saving.

In the present invention, the blade to be incorporated in the metallic charger may be made of various metals, such as aluminum, iron, nickel, stainless steel, tungsten, molybdenum, titanium and the like. Further, the portion of the blade to be brought into contact with the electrophotographic photoreceptor may be coated with an amorphous silicon or amorphous carbon containing at least one of carbon, nitrogen, oxygen and the Group III or V elements (e.g., B, Al, P, and N) of the periodic table and containing hydrogen and/or halogen. This coating exerts an effect of inhibiting the fluctuations of supply voltage due to pinholes in the photoreceptor. This coating also exerts an effect of reducing the abrasion of the metal blade.

In the present invention, the metallic charger is arranged such that a voltage is externally applied across it. The voltage applied may normally range from 50 V to 2,000 V and preferably from 100 to 1,500 V.

The photoreceptor may be heated to 30° C. to 80° C. to enhance the fixability and reduce the required fixing pressure. If the amorphous silicon photoreceptor is heated to a temperature of higher than 80° C., its dark resistance is lowered, making it difficult to obtain a static potential necessary for development. The photoreceptor may be internally heated in the copying machine, or it may be heated externally.

As the heating means there may be used a lamp heater (quartz lamp) or a planar heater comprising a nickel chrome wire arranged in a heat-resistant plastic rubber such as silicone rubber. Besides these heating means, hot air type heater, heater utilizing radiation such as infrared rays, heater utilizing heat from the fixing zone, etc. can be used. Any means for supplying electric power to the photoreceptor there may be used. In particular, if the heating means is provided inside the substrate of the photoreceptor, the electric power supplying means is preferably arranged to supply electric power into the heating means via a slip ring.

As the transfer-fixing roll there may be used a roll made of a synthetic resin such as polyvinyl acetal resin, polyurethane, melamine and unsaturated polyester. In general, transfer and fixing can be effected simultaneously by applying a pressure of 50 to 1,000 kg/cm$^2$, preferably 100 to 700 kg/cm$^2$, to the photoreceptor.

Figure 3:
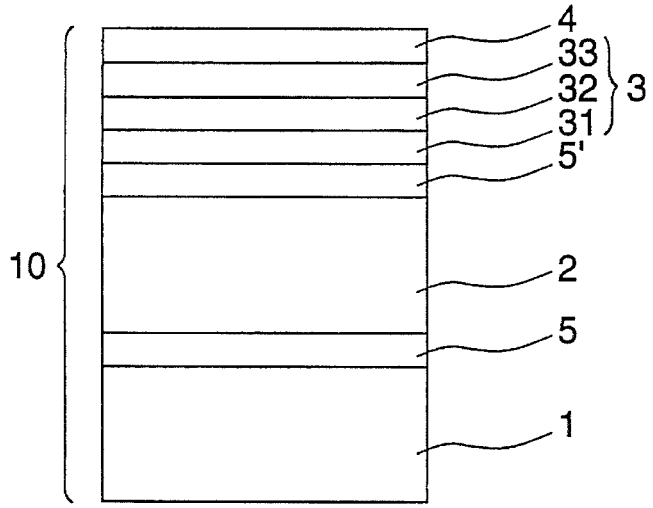
FIG. 3 is a sectional view of an embodiment of the electrophotographic photoreceptor according to the present invention.
Figure 4:
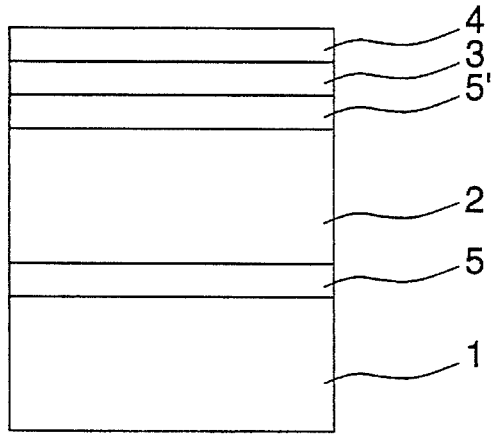
FIG. 4 is a sectional view of another embodiment of the electrophotographic photoreceptor according to the present invention.
Figure 5:
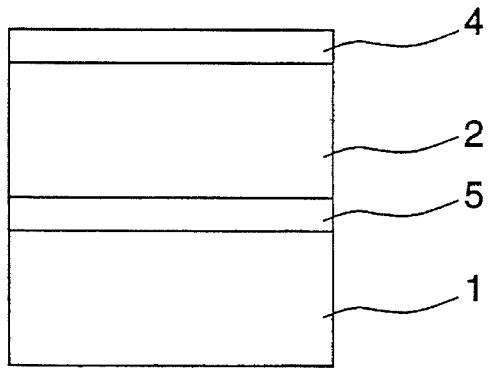
FIG. 5 is a sectional view of a further embodiment of the electrophotographic photoreceptor according to the present invention.

The process of the present invention is preferably applied to an amorphous silicon photoreceptor having a surface layer, as shown in FIG. 3 to 5. In FIG. 3, photoreceptor 10 comprises electrically conductive substrate 1 having first electric charge injection-inhibiting layer 5, amorphous silicon photoconductive layer 1, second electric charge injection-inhibiting layer 5', interlayer 3 (sublayers 31 to 33) and surface layer 4 laminated thereon in this order. In FIG. 4, a single interlayer is incorporated in the system. In FIG. 5, the second electric charge injection-inhibiting layer and interlayers are omitted.

Examples of the electrically conductive substrate materials to be used in the present invention include metal such as aluminum, stainless steel, nickel and chromium, and alloy thereof. Further, electrically-conducted insulating substrates including films or sheets of high molecular compounds such as polyester, polyethylene, polycarbonate, polystyrene, polyamide and polyimide, glass, and ceramic may also be used. The insulating substrate is made electrically conductive on at least the side thereof to be brought into contact with the other constituting layers by, for example, vacuum evaporation, sputtering or ionic plating of gold, silver, copper or the like.

The electrically conductive substrate to be used in the present invention may also be made of a Cr-Ni-containing copper, so-called austenite stainless steel, which may have an electrically conductive layer mainly made of molybdenum, chromium, manganese, tungsten or titanium formed thereon. Such an electrically conductive layer can be formed by plating, sputtering or vacuum evaporation.

Besides, an aluminum substrate having an electrically conductive layer mainly made of chromium, titanium, tungsten or molybdenum formed thereon may be used. Further, an electrically conductive substrate made of molybdenum, tungsten or titanium may also be used.

The thickness of the electrically conductive support may be in the range of 0.5 to 50 mm, preferably 1 to 20 mm.

The electrically conductive support may be polished before use. Specifically, the electrically conductive support may be polished repeatedly by buffing, honing or like method, with the particle size of abrasives used being changed from large to small. The maximum surface roughness (Rmax) according to JISB0601-1082 generally ranges from 0.02 to 2 μm, preferably from 0.03 to 0.5 μm. The electrically conductive support may be either a specular surface or a frosted surface developed by fine lines but needs to be generally smooth enough to leave no protrusions at the cutting pitch interface developed by lathe cutting.

The first electric charge injection-inhibiting layer is made of an amorphous silicon containing Group III or V elements, which of the elements be added depends on the polarity of the photoreceptor to be charged. For formation of the first electric charge injection-inhibiting layer, a starting gas containing the Group III elements such as diborane ($B_2H_6$) or a starting gas containing the Group V elements such as phosphine ($PH_3$) or ammonia ($NH_3$) is typically used. The electric charge injection-inhibiting layer mainly comprising an amorphous silicon may further comprise elements such as N, C, O and halogen, other than the Group III or V elements, for the purpose of enhancing adhesion of the layer.

The photoconductive layer is formed mainly by an amorphous silicon containing hydrogen and/or halogen. The thickness of the photoconductive layer is preferably in the range of 1 to 100 μm, more preferably 1 to 10 μm. The content of hydrogen and/or halogen ranges from 3 to 40 atom %. The photoconductive layer may comprise an impurity element for controlling the electrical conductivity thereof, preferably the Group III element or the like. Diborane ($B_2H_6$) may be typically used as starting gas containing the Group III elements. The amount of the Group III elements to be added is determined by the polarity of the photoreceptor to be charged and the required spectral sensitivity and is generally in the range of 0.01 to 1,000 ppm, preferably 0.01 to 100 ppm. The photoconductive layer may further comprise elements such as N, C and O, other than the Group III elements, for the purpose of enhancing chargeability and sensitivity and reducing darkdecay. Further, the photoconductive layer may be composed of two layers, i.e., charge generating layer and charge transport layer. Moreover, the photoconductive layer may contain at least one of Ge and Sn, which can be added using a starting gas containing Ge or Sn (e.g., germanium tetrafluoride and tin chloride).

The second electric charge injection-inhibiting layer 5' is made of an amorphous silicon containing the Group III or V elements, which of the elements be added depends on the polarity of the photoreceptor to be charged. Diborane, phosphine, ammonia or the like may be used for forming the second electric charge injection-inhibiting layer. The layer may further comprise other elements for various purposes. The film thickness is preferably in the range of 0.01 to 10 μm.

The electrophotographic photoreceptor used in the process of the present invention may be free of interlayer as shown in FIG. 5. If an interlayer is present, it may be a single layer as shown in FIG. 4 or may consist of a plurality of layers as shown in FIG. 3.

The interlayer is mainly made of an amorphous silicon containing carbon, oxygen or nitrogen atom. The interlayer may comprise other elements incorporated therein for various purposes.

For formation of the interlayer, other than $N_2$, any compound containing nitrogen atom as a constituent can be used as N-containing starting gas as long as it is gaseous. Specifically, hydrogenated nitrogen compound as described later can be used. If the interlayer consists of a plurality of layers, the starting gases containing nitrogen atom to be used may be the same or different. The atomic ratio of carbon, oxygen or nitrogen to silicon in the interlayer preferably increases toward the surface layer.

Referring to FIG. 3 by way of example, the atomic ratio of carbon, oxygen or nitrogen atom to silicon atom in first interlayer 31 is preferably in the range of 0.1/1 to less than 1.0/1. The thickness of the first interlayer is preferably in the range of 0.01 to 0.1 μm.

The atomic ratio of carbon, oxygen or nitrogen atom to silicon atom in second interlayer 32 is higher than that of first interlayer 31 and is preferably in the range of more than 0.1/1 to 1.0/1. The thickness of the second interlayer is preferably in the range of 0.05 to 1 μm.

The atomic ratio of carbon, oxygen or nitrogen atom to silicon atom in third interlayer 33 is higher than that of second interlayer 32 and is preferably in the range of 0.5/1 to 1.3/1. The thickness of the third interlayer is preferably in the range of 0.01 to 0.1 μm.

As the constituent materials of surface layer 36 to be provided on the photoconductive layer or the interlayer there may be used amorphous silicon (a-Si), amorphous silicon oxide (a-$SiO_x$), amorphous silicon nitride (a-$SiN_x$), amorphous silicon carbide (a-$SiC_x$), amorphous carbon (a-C), $AlO_x$, or the like, which is deposited by plasma CVD method, vacuum evaporation method, ion plating method, etc. In the present invention, the surface layer is preferably made of a-Si or a-C containing at least one element selected from the group consisting of carbon, nitrogen and oxygen, and further containing hydrogen and/or halogen. Such an surface layer is effective to prevent the surface of the amorphous silicon photoreceptor from being marred upon pressure fixing or to improve the transfer efficiency.

The surface layer preferably exhibits a contact angle of 60° or more, more preferably 80° or more, with respect to pure water droplet. A specific preferred example of the surface layer formed according to the present invention is a-C containing H and/or F, or a-$C_xSi_{(1-x)}$ containing H and/or F (wherein x>0.5), formed by plasma CVD of hydrogenated and/or halogenated hydrocarbon.

The thickness of the surface layer is generally in the range of 0.01 to 10 μm.

Figure 6:
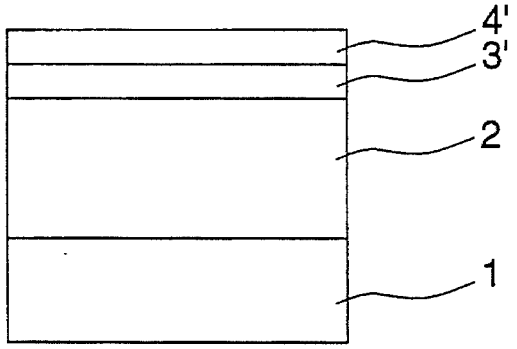
FIG. 6 to 8 are sectional views of preferred amorphous silicon photoreceptors of the present invention.
Figure 7:
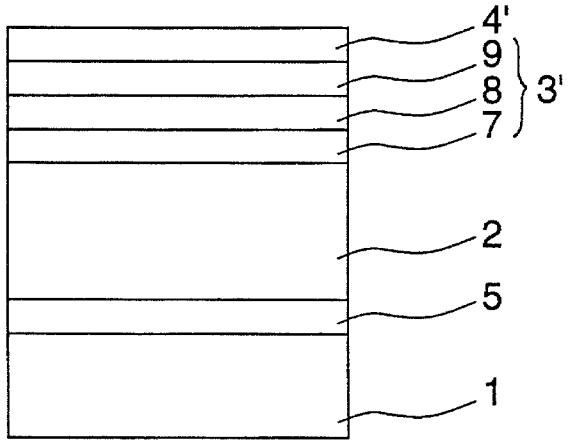
Figure 8:
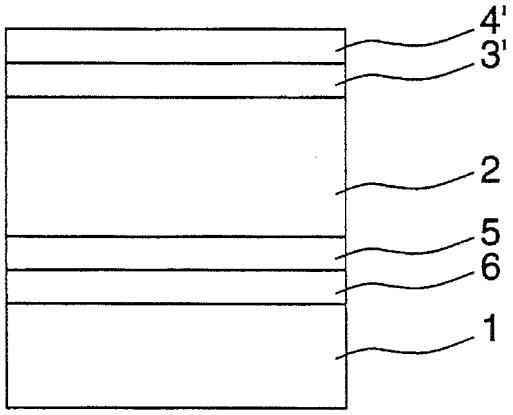

FIG. 6 to 8 are sectional views of preferred electrophotographic photoreceptors of the present invention which are particularly suitable for the process using a contact type metallic charger as shown in FIG. 2. In FIG. 6, the electrophotographic photoreceptor comprises electrically conductive support 1, and amorphous silicon photoconductive layer 2, electric charge trap layer 3' as an interlayer having an enhanced charge trapping property and electric charge injection layer 4' as a surface layer having an enhanced charge injection property when charged by a contact type charger laminated thereon in this order. Referring to FIG. 7, electric charge injection-inhibiting layer 5 is provided interposed between the electrically conductive support and the photoconductive layer. The electric charge trap layer has a laminated structure consisting of three sublayers 7, 8 and 9. Referring to FIG. 8, auxiliary layer 6 is provided interposed between the electrically conductive support and the electric charge injection-inhibiting layer.

Electric charge injection-inhibiting layer 5 which is optionally provided on the electrically conductive support comprises an amorphous silicon or amorphous carbon having the Group III or V elements (e.g., B, Al, P, and N) incorporated therein. Selection of the Group III or V elements depends on the polarity of the photoreceptor to be charged. In addition to the Group III or V elements, at least one of nitrogen, oxygen, carbon and a halogen atom may be incorporated in the electric charge injection-inhibiting layer. The electric charge injection-inhibiting layer may also be provided on the photoconductive layer. The thickness of the electric charge injection-inhibiting layer is generally from 0.01 to 10 μm, preferably from 0.05 to 5 μm.

Further, auxiliary layer 6 which serves as an adhesive layer may be provided interposed between the electric charge injection layer and the electrically conductive support. The auxiliary layer may comprise an amorphous silicon containing at least one element selected from the group consisting of nitrogen, carbon and oxygen. The thickness of the auxiliary layer may range from 0.01 to 5 μm, preferably from 0.1 to 1 μm.

Electric charge trap layer 3' formed on the photoconductive layer comprises an amorphous silicon or amorphous carbon containing at least one element selected from the group consisting of carbon, nitrogen, oxygen and the Group III or V elements.

If the electric charge trap layer is mainly made of an amorphous silicon, the amorphous silicon may contain hydrogen and/or halogen in an amount of 3 to 40 atom %. If the electric charge trap layer is mainly made of an amorphous carbon, the amorphous carbon may contain hydrogen and/or halogen in an amount of 5 to 50 atom %. In the case of amorphous carbon, if a large amount of hydrogen or halogen is incorporated in the film, the rate of chain —$CH_2$—, —$CF_2$— or —$CH_3$ bonds increases in the film, resulting in the deterioration of the film hardness. Therefore, the content of hydrogen or halogen in the film needs to be not more than 50 atom %.

If the electric charge trap layer contains the Group III or V elements, selection of the Group III or V elements depends on the polarity of the photoreceptor to be charged. Specifically, if the photoreceptor is positively charged, it may contain the Group V elements. On the contrary, if the photoreceptor is negatively charged, it may contain the Group III elements. The content of the group V elements and the Group III elements may be properly determined from the ranges of from 0.01 to 1,000 ppm and from 5 to 10,000 ppm, respectively, depending on the layer thickness. The thickness of the electric charge trap layer is generally from 0.01 to 10 μm, preferably from 0.1 μm to 5 μm.

In order to control the trap density of the electric charge trap layer, it is effective to incorporate at least one of carbon, oxygen and nitrogen into the electric charge trap layer. The content of such an element may range from 1 to 99.9 atom % for carbon, from 1 ppm to 60 atom % for oxygen or from 1 ppm to 60 atom % for nitrogen.

Electric charge injection layer 4' provided on the electric charge trap layer comprises an amorphous silicon or amorphous carbon containing the Group III or V elements.

If the electric charge injection layer is mainly made of an amorphous silicon, the amorphous silicon may contain hydrogen and/or halogen in an amount of 3 to 40 atom %. If the electric charge trap layer is mainly made of an amorphous carbon, the amorphous carbon may contain hydrogen and/or halogen in an amount of 5 to 50 atom %. In the case of amorphous carbon, if a large amount of hydrogen or halogen is incorporated in the film, the rate of chain $—CH_2—$, $—CF_2—$ or $—CH_3$ bonds increases in the film, resulting in the deterioration of the film hardness. Therefore, the content of hydrogen or halogen in the film needs to be not more than 50 atom %.

Selection of the Group III or V elements depends on the polarity of the photoreceptor to be charged. If the photoreceptor is positively charged, the electric charge injection layer may contain the Group III elements. On the contrary, if the photoreceptor is negatively charged, the electric charge injection layer may contain the Group V elements. The contents of the Group III elements and the group V elements generally range from 0.1 to 100 ppm and from 0.01 to 10,000 ppm, respectively.

The electric charge injection layer may comprise one or more elements of nitrogen, oxygen and carbon for the purpose of controlling the charge accetability and enhancing the surface hardness. The content of nitrogen, if any, may range from 1 ppm, to 20 atom %.

The thickness of the electric charge injection layer is generally from 0.01 to 10 μm, preferably from 0.1 to 5 μm.

The electric charge trap layer or electric charge injection layer may consist of two or more layers made of an amorphous silicon containing one or more elements selected from the Group III or V elements as mentioned above, nitrogen, oxygen and carbon, or may be formed by laminating layers made of an amorphous carbon containing hydrogen and/or halogen. FIG. 7 illustrates another embodiment of the photoreceptor according to the present invention wherein the electric charge injection layer 4' and electric charge trap layers 7, 8 and 9 are laminated.

In the case where the electric charge trap layer consists of a plurality of layers as shown in FIG. 7, the various constituent layers are preferably arranged as follows. Specifically, first constituent layer 7 has an atomic ratio of carbon, oxygen or nitrogen atomic to silicon of 0.1/1 to less than 1.0/1 and a thickness of 0.01 to 0.1 μm. Second constituent layer 8 has an atomic ratio of carbon, oxygen or nitrogen to silicon of more than 0.1/1 to 1.0/1 and a thickness of 0.05 to 1 μm. Third constituent layer 9 has an atomic ratio of carbon, oxygen or nitrogen to silicon of 0.5/1 to 1.3/1 which is higher than that in the second constituent layer and a thickness of 0.01 to 0.1 μm.

The method for the formation of the various layers on the electrically conductive support will be described hereinafter.

The formation of the various layers on the electrically conductive support can be accomplished by glow discharge decomposition method via plasma CVD method, sputtering method, ion plating method, vacuum evaporation method or the like.

As the starting gas there may be used a main starting gas containing silicon atom for the photoconductive layer and auxiliary layer; and a main starting gas containing silicon atom or a main starting gas containing a hydrocarbon or halogen-substituted hydrocarbon for electron charge injection-inhibiting layer, the electric charge trap layer and electric charge injection layer.

Referring to glow discharge decomposition method, the process for the preparation of these layers will be further described hereinafter. The main starting gas is mixed with a starting gas containing necessary additive elements, optionally combined with hydrogen or an inert gas such as helium, argon and neon.

The glow discharge decomposition may be effected by DC or AC discharge. The conditions under which film making is conducted are 0 to 5 GHz for frequency, $10^{-5}$ to 10 Torr (0.001 to 1,333 Pa) for inner pressure of reaction vessel, and 10 to 3,000 W for discharge power. The support temperature may be predetermined to 30° to 400° C. The resulting film thickness can be properly predetermined by adjusting the discharge time.

In the case where a layer comprising an amorphous silicon is formed, as the main starting gas containing silicon atom there may be used silanes, particularly $SiH_4$ and/or $Si_2H_6$. As the starting gas for incorporating nitrogen, oxygen and carbon in the layer there may be used the following gas: a hydrogenated nitrogen compound (e.g., $N_2$, $NH_3$, $N_2H_4$ and $HN_3$) as the starting gas containing nitrogen; a hydrocarbon (e.g., methane, ethane, propane and acetylene) or a halogenated hydrocarbon (e.g., $CF_4$ and $C_2F_6$) as the starting gas containing carbon; and $O_2$, $N_2O$, CO, $CO_2$ or the like as the starting gas containing oxygen.

A typical example of the starting gas containing the Group III elements is diborane ($B_2H_6$). In addition, $AlH_3$, etc. can be used. A typical example of the starting gas containing the Group V elements is $PH_3$.

Examples of the starting material to be used for the formation of the layer comprising an amorphous carbon include aliphatic hydrocarbons such as paraffinic hydrocarbon represented by formula $C_nH_{2n+2}$ (e.g., methane, ethane, propane, butane and pentane), olefinic hydrocarbon represented by formula $C_nH_{2n}$ (e.g., ethylene, propylene, butylene and pentene), and acetylenic hydrocarbon represented by formula $C_nH_{2n-2}$ (e.g., acetylene, arylene and butyne); alicyclic hydrocarbons such as cyclopropane, cyclobutane, cyclopentane, cyclohexane, cycloheptane, cyclobutene, cyclopentene and cyclohexene; aromatic hydrocarbons such as benzene, toluene, xylene, naphthalene and anthracene; and substituted compounds thereof. These hydrocarbon compounds may be branched or substituted. For example, halogenated hydrocarbons such as carbon tetrachloride, chloroform, carbon tetrafluoride, trifluoromethane, chlorotrifluoromethane, dichlorodifluoromethane, bromotrifluoromethane, perfluoroethane and perfluoropropane may be used.

The above listed carbon materials may be gas, solid or liquid at normal temperature. If these carbon materials are solid or liquid, they are used in the form of vapor.

Toner particles which are used to develop an electrostatic latent image in the process of the present invention are not particularly limited, and conventional toner particles can be used. Pressure-fixable toner particles (i.e., which can be fixed under pressure) are particularly preferred since an electrophotographic apparatus can be simplified. For the purpose, a capsule toner is suitably used as the transfer and fixing can be easily effected by application of pressure.

The capsule toner consists of a core material and a shell material. As the core material there may be preferably used a material comprising a binder resin, a high boiling solvent for dissolving the binder resin therein, and a coloring material, or a material mainly comprising a soft solid material and a coloring material. The core material may optionally comprise an additive such as silicone oil for the purpose of improving fixability. A high boiling solvent incapable of dissolving a binder resin may be added to the high boiling solvent.

Conventional binder resin may be used as one ingredient of the core material. Examples of binder resin include acrylic ester polymers such as polymethyl acrylate, polyethyl acrylate, polybutyl acrylate, poly-2-ethylhexyl acrylate and polylauryl acrylate; methacrylic ester polymers such as polymethyl methacrylate, polybutyl methacrylate, polyhexyl methacrylate, poly-2-ethylhexyl methacrylate and polylauryl methacrylate, copolymers of styrenic monomer and acrylic or methacrylic ester; ethylenic polymers and copolymers such as polyvinyl acetate, polyvinyl propionate, polyvinyl butyrate, polyethylene and polypropylene; styrenic copolymers such as styrene-butadiene copolymer and styrene-maleic acid copolymer; polyvinyl ethers; polyvinyl ketones; polyesters; polyamides; polyurethanes; rubbers; epoxy resins; polyvinyl butyrals; rosins; modified rosins; terpene resins; phenolic resins; etc. They may be used singly or in combination. Alternatively, these materials may be charged into the system in the form of monomer, capsulized, and then polymerized to form a binder resin in situ.

Examples of high boiling solvent include an oil solvent having a boiling point of 140° C. or higher, preferably 160° C. or higher, such as phthalic esters (e.g., diethyl phthalate, dibutyl phthalate), aliphatic dicarboxylic esters (e.g., diethyl malonate, dimethyl oxalate), phosphoric esters (e.g., tricresyl phosphate, trixylyl phosphate), citric esters (e.g., o-acetyltriethyl citrate), benzoic esters (e.g., butyl benzoate, hexyl benzoate), aliphatic esters (e.g., hexadecyl myristate, dioctyl adipate), alkylnaphthalenes (e.g., methylnaphthalene, dimethylnaphthalene, monoisopropylnaphthalene, diisopropylnaphthalene), alkyldiphenylethers (e.g., o-, m-, p-methyldiphenylether), higher aliphatic or aromatic sulfonic amide compounds (e.g., N,N-dimethyllauramide, N-butylbenzenesulfonamide), trimellitic esters (e.g., trioctyl trimellitate), diarylalkanes (e.g., diarylmethane such as dimethylphenylphenylmethane, diarylethane such as 1-phenyl-1-methylphenylethane, 1-dimethylphenyl-1-phenylethane, 1-ethylphenyl- 1-phenylethane), and chlorinated paraffins.

Any soft solid material may be used as long as it exhibits sufficient flexibility and flexability at room temperature, and it is preferably a polymer having Tg of −60° C. to 5° C.

Examples of the coloring material include inorganic pigments such as carbon black, red oxide, Prussian blue and titanium oxide; azo pigments such as fast yellow, disazo yellow, pyrazolone red, chelate red, brilliant carmine and parabrown; phthalocyanines such as copper phthalocyanine and metal-free phthalocyanine; and condensed polycyclic pigments such as flavanthrone yellow, dibromoanthrone orange, perylene red, quinacridone red and dioxazine violet. Further, disperse dyes, oil-soluble dyes and the like can be used.

If the capsule toner to be used in the present invention is a single-component type developer (i.e., with no carrier particles), all or some part of a black coloring material in the core material may be replaced with a magnetic powder. For the purpose, cobalt, iron, nickel and its alloy thereof, as well as magnetite and ferrite, may be used. The magnetic powder may be surface-treated with a coupling agent such as silane coupling agent and titanate coupling agent or an oil-soluble surface active agent or may be coated with an acrylic resin, styrene resin, epoxy resin or the like.

To impart fluidity or chargeability to the capsule toner, silicon oxide, aluminum oxide, titanium oxide or carbon black may be added as external additives, for example, by attaching it to the surface of the capsule toner by means of a mixer such as V-blender and Henschel mixer in a dry process or by dispersing the additive in water or an aqueous liquid such as water/alcohol, adding the dispersion to the capsule toner in the form of slurry, and then drying so that the additive is attached to the surface of the toner.

The shell material is preferably a polyurea resin, polyurethane resin, polyamide resin, polyester resin, epoxy resin, epoxyurea resin or epoxyurethane resin.

A capsulation method is not specifically limited. From the views of coating and mechanical strength of shell, capsulation by interfacial polymerization is particularly preferred. The preparation of capsule toner by interfacial polymerization can be accomplished by a known method (as disclosed in JP-A-57-179860, JP-A-58-66948, JP-A-59-148066, and JP-A-59-162562).

Incorporation of the foregoing polymer (binder resin) in the capsules as a component of the core material can be accomplished by charging it in the system in the form of polymerizable material together with other core-forming components, a low boiling solvent and shell-forming components, forming a shell by interfacial polymerization, and then simultaneously or after the formation of the shell, expelling the low boiling solvent from the system to form a core.

In the present invention, the particle diameter of the capsule toner is preferably in the range of 5 to 25 μm as calculated in terms of volume-average particle diameter.

In the case of capsule toner, a material which exhibits an excellent fixability can be used as the core material. Therefore, fixing can be effected under a pressure of about ⅘ to ½ of the normal fixing pressure.

The present invention will be further described in the following Examples and Comparative Examples, but the present invention should not be construed as being limited thereto.

EXAMPLE 1

An amorphous silicon photoreceptor was prepared by providing a p-type electric charge injection-inhibiting layer, a photoconductive layer, an electric charge trap layer having a total thickness of 0.4 μm consisting of two layers made of $SiN_x$, and a p-type electric charge injection layer having a thickness of 1.0 μm in this order on a cylindrical aluminum substrate having a thickness of 4 mm and a surface roughness ($R_{max}$) of 0.05 μm.

Specifically, a reaction vessel in which the cylindrical substrate had been placed was evacuated. Into the reaction vessel was then introduced a mixture of silane gas, hydrogen gas and diborane gas. The cylindrical substrate was then subjected to glow discharge decomposition to form a 2-μm thick electric charge injection-inhibiting layer thereon. The conditions under which the film was formed are as follows:

Flow rate of 100% silane gas: 180 $cm^3$/min.

Flow rate of 100% hydrogen gas: 90 $cm^3$/min.

Flow rate of 200 ppm hydrogen-diluted diborane gas: 90 $cm^3$/min.

Inner pressure of reaction vessel: 1.0 Torr

Discharge power: 200 W

Discharge time: 60 min.

Discharge frequency: 13.56 MHz

Substrate temperature: 250° C.

(In the preparation of the other various layers, the discharge frequency and support temperature were the same as specified above.)

After formation of the electric charge injection-inhibiting layer, the reaction vessel was thoroughly evacuated. Into the reaction vessel was then introduced a mixture of silane gas, hydrogen gas and diborane gas. The material was then subjected to glow discharge decomposition to form a 20-μm thick photoconductive layer on the electric charge injection-inhibiting layer. The conditions under which the film was formed are as follows:

Flow rate of 100% silane gas: 180 $cm^3$/min.

Flow rate of 100% hydrogen gas: 162 $cm^3$/min.

Flow rate of 20 ppm hydrogen-diluted diborane gas: 18 $cm^3$/min.

Inner pressure of reaction vessel: 1.0 Torr

Discharge power: 300 W

Discharge time: 200 min.

After formation of the photoconductive layer, the reaction vessel was thoroughly evacuated. Into the reaction vessel was then introduced a mixture of silane gas, hydrogen gas and ammonia gas. The material was then subjected to glow discharge decomposition to form a 0.15-μm thick first electric charge trap layer on the photoconductive layer. The conditions under which the film was formed are as follows:

Flow rate of 100% silane gas: 20 $cm^3$/min.

Flow rate of 100% hydrogen gas: 180 $cm^3$/min.

Flow rate of 100% ammonia gas: 30 $cm^3$/min.

Inner pressure of reaction vessel: 0.5 Torr

Discharge power: 50 W

Discharge time: 30 min.

After formation of the first electric charge trap layer, the reaction vessel was thoroughly evacuated. Into the reaction vessel was then introduced a mixture of silane gas, hydrogen gas and ammonia gas. The material was then subjected to glow discharge decomposition to form a 0.25-μm thick second electric charge trap layer on the first electric charge trap layer. The conditions under which the film was formed are as follows:

Flow rate of 100% silane gas: 24 $cm^3$/min.

Flow rate of 100% hydrogen gas: 180 $cm^3$/min.

Flow rate of 100% ammonia gas: 36 $cm^3$/min.

Inner pressure of reaction vessel: 0.5 Torr

Discharge power: 50 W

Discharge time: 40 min.

After formation of the second electric charge trap layer, the reaction vessel was thoroughly evacuated. Into the reaction vessel was then introduced a mixture of silane gas, hydrogen gas and diborane gas. The material was then subjected to glow discharge decomposition to form a 1.0-μm thick electric charge injection layer on the second electric charge trap layer. The conditions under which the film was formed are as follows:

Flow rate of 100% silane gas: 180 $cm^3$/min.

Flow rate of 100% hydrogen gas: 90 $cm^3$/min.

Flow rate of 200 ppm hydrogen-diluted diborane gas: 150 $cm^3$/min.

Inner pressure of reaction vessel: 1.0 Torr

Discharge power: 200 W

Discharge time: 20 min.

The electrophotographic photoreceptor thus prepared was mounted in a printer as shown in FIG. 1. An image formation operation was then effected at a rate of 40 sheets per minute. In metallic charger 11, a voltage of +400 V was applied across a 0.5-mm thick steel blade having a polished tip. With a single-component type developer, magnetic brush development was effected, and a toner image formed on the photoreceptor was electrostatically transferred to a paper and fixed. The resulting image was sharp and showed no fogging.

EXAMPLE 2

An amorphous silicon photoreceptor was prepared in the same manner as in Example 1, except that an n-type electric charge injection-inhibiting layer, a photoconductive layer, a 0.1-μm thick p-type electric charge trap layer, and 1-μm thick n-type electric charge injection layer were provided on the substrate in this order. The conditions under which the electric charge injection-inhibiting layer was formed are as follows:

Flow rate of 100% silane gas: 20 $cm^3$/min.

Flow rate of 100% hydrogen gas: 180 $cm^3$/min.

Flow rate of 100% ammonia gas: 20 $cm^3$/min.

Inner pressure of reaction vessel: 0.5 Torr

Discharge power: 50 W

Discharge time: +1 min.

After formation of the electric charge injection-inhibiting layer, the reaction vessel was thoroughly evacuated. Into the reaction vessel was then introduced a mixture of silane gas, hydrogen gas and diborane gas. The material was then subjected to glow discharge decomposition to form a 20-μm thick photoconductive layer on the electric charge injection-inhibiting layer. The conditions under which the film was formed are as follows:

Flow rate of 100% silane gas: 180 $cm^3$/min.

Flow rate of 100% hydrogen gas: 162 $cm^3$/min.

Flow rate of 20 ppm hydrogen-diluted diborane gas: 18 $cm^3$/min.

Inner pressure of reaction vessel: 1.0 Torr

Discharge power: 300 W

Discharge time: 200 min.

After the formation of the photoconductive layer, the reaction vessel was thoroughly evacuated. Into the reaction vessel was then introduced a mixture of silane gas, hydrogen gas and diborane gas. The material was then subjected to glow discharge decomposition to form a 1-μm thick electric charge trap layer on the photoconductive layer. The conditions under which the film was formed are as follows:

Flow rate of 100% silane gas: 180 $cm^3$/min.

Flow rate of 200 ppm hydrogen-diluted diborane gas: 180 $cm^3$/min.

Inner pressure of reaction vessel: 1.0 Torr

Discharge power: 200 W

Discharge time: 10 min.

Into the reaction vessel was then introduced a mixture of silane gas, hydrogen gas and ammonia gas. The material was then subjected to glow discharge decomposition to form a 1.0-μm thick electric charge injection layer on the electric charge trap layer. The conditions under which the film was formed are as follows:

Flow rate of 100% silane gas: 40 $cm^3$/min.

Flow rate of 100% hydrogen gas: 180 $cm^3$/min.

Flow rate of 100% ammonia gas: 20 $cm^3$/min.

Inner pressure of reaction vessel: 0.5 Torr

Discharge power: 50 W

Discharge time: 30 min.

The electrophotographic photoreceptor thus prepared was then subjected to image formation test in the same manner as in Example 1 except that the voltage applied across the metallic charger was −400 V and the polarity of the developer was altered. The resulting image was sharp and showed no fogging.

EXAMPLE 3

The same electrophotographic photoreceptor as prepared in Example 2 was mounted in a printer as shown in FIG. 2. An image formation operation was then effected at a rate of 40 sheets per minute. As the metallic charger/cleaner there was used the same steel blade as used in Example 1. A voltage of −400 V was applied across the metallic charger. After an image test of 100,000 sheets, the photoreceptor showed no toner and additives attached to the surface thereof and exhibited a stable chargeability. The resulting image was sharp.

EXAMPLE 4

With a capsule toner having a grain diameter of 15 μm comprising a core material made of a lauryl methacrylate polymer (molecular weight: $10\times10^4$) and a magnetic powder covered with a polyrea resin, an image was formed by means of a copying apparatus in which an amorphous silicon photoreceptor having an interlayer and surface layer made of $SiN_x$ as mentioned below had been mounted as shown in FIG. 2.

The foregoing capsule toner was prepared as follows:

| | |
|---|---|
| (Core material) | |
| Lauryl methacrylate polymer | 40 parts by weight |
| Magnetic powder (EPT-100, available from Toda Kogyo K.K.) | 60 parts by weight |
| (Shell material) | |
| Polyurea resin (product of interfacial polymerization of polyisocyanate ("Sumidur L-75" available from Sumitomo Bayer Urethane Co.) and diethylenetriamine) | |

To some part of the foregoing core material was added the polyurea resin. The material was then emulsion-granulated. To the material was then added an aqueous solution of diethylenetriamine. The material was then allowed to undergo interfacial polymerization to prepare capsule grains. The capsule grains were then dried by a spray dryer.

To the capsule toner thus obtained were then added the following components in admixture so that it was rendered electrically conductive.

| | |
|---|---|
| Carbon black (Vulcan XC72, available from Cabot Co.) | 2 parts by weight |
| Zinc stearate | 0.5 parts by weight |

The amorphous silicon photoreceptor used was prepared as follows:

The reaction vessel in which a cylindrical Al-Mg alloy substrate having a thickness of about 20 μm had been charged was thoroughly evacuated. Into the reaction vessel was then introduced a mixture of silane gas, hydrogen gas and diborane gas. The material was then subjected to glow discharge decomposition to form a 4-μm thick first electric charge injection-inhibiting layer on the substrate. The conditions under which the film was formed are as follows:

Flow rate of 100% silane gas: 180 $cm^3$/min.

Flow rate of 100% hydrogen gas: 90 $cm^3$/min.

Flow rate of 200 ppm hydrogen-diluted diborane gas: πl $cm^3$/min.

Inner pressure of reaction vessel: 1.0 Torr

Discharge power: 200 W

Discharge time: 60 min.

Discharge frequency: 13.65 MHz

Support temperature: 250° C.

(In the preparation of the other various layers, the discharge frequency and support temperature were the same as specified above.)

After the formation of the first electric charge injection-inhibiting layer, the reaction vessel was thoroughly evacuated. Into the reaction vessel was then introduced a mixture of silane gas, hydrogen gas and diborane gas. The material was then subjected to glow discharge decomposition to form a 15-μm thick photoconductive layer on the first electric charge injection-inhibiting layer. The conditions under which the film was formed are as follows:

Flow rate of 100% silane gas: 180 $cm^3$/min.

Flow rate of 100% hydrogen gas: 162 $cm^3$/min.

Flow rate of 20 ppm hydrogen-diluted diborane gas: 18 $cm^3$/min.

Inner pressure of reaction vessel: 1.0 Torr

Discharge power: 200 W

Discharge time: 210 min.

After the formation of the photoconductive layer, the reaction vessel was thoroughly evacuated. Into the reaction vessel was then introduced a mixture of silane gas, hydrogen gas and diborane gas. The material was then subjected to glow discharge decomposition to form a 0.9-μm thick second electric charge injection-inhibiting layer on the photoconductive layer. The conditions under which the film was formed are as follows:

Flow rate of 100% silane gas: 180 $cm^3$/min.

Flow rate of 100% hydrogen gas: 90 $cm^3$/min.

Flow rate of 20 ppm hydrogen-diluted diborane gas: 90 $cm^3$/min.

Inner pressure of reaction vessel: 1.0 Torr

Discharge power: 200 W

Discharge time: 12 min.

After the formation of the second electric charge injection-inhibiting layer, the reaction vessel was thoroughly evacuated. Into the reaction vessel was then introduced a mixture of silane gas, hydrogen gas and ammonia gas. The material was then subjected to glow discharge decomposition to form a first interlayer having a thickness of about 0.15 μm on the second electric injection-inhibiting layer. The conditions under which the film was formed are as follows:

Flow rate of 100% silane gas: 26 $cm^3$/min.

Flow rate of 100% hydrogen gas: 180 $cm^3$/min.

Flow rate of 100% ammonia gas: 30 $cm^3$/min.

Inner pressure of reaction vessel: 0.5 Torr

Discharge power: 50 W

Discharge time: 30 min.

After the formation of the first interlayer, the reaction vessel was thoroughly evacuated. Into the reaction vessel was then introduced a mixture of silane gas, hydrogen gas and ammonia gas. The material was then subjected to glow discharge decomposition to form a second interlayer having a thickness of about 0.25 μm on the first interlayer. The conditions under which the film was formed are as follows:

Flow rate of 100% silane gas: 24 $cm^3$/min.

Flow rate of 100% hydrogen gas: 180 $cm^3$/min.

Flow rate of 100% ammonia gas: 36 $cm^3$/min.

Inner pressure of reaction vessel: 0.5 Torr

Discharge power: 50 W

Discharge time: 40 min.

After the formation of the second interlayer, the reaction vessel was thoroughly evacuated. Into the reaction vessel was then introduced a mixture of silane gas, hydrogen gas and ammonia gas. The material was then subjected to glow discharge decomposition to form a surface layer having a thickness of about 0.1 μm on the second interlayer. The conditions under which the film was formed are as follows:

Flow rate of 100% silane gas: 15 $cm^3$/min.

Flow rate of 100% hydrogen gas: 180 $cm^3$/min.

Flow rate of 100% ammonia gas: 43 $cm^3$/min.

Inner pressure of reaction vessel: 0.5 Torr

Discharge power: 50 W

Discharge time: 20 min.

The formation of an image was effected by means of an apparatus shown in FIG. 2. The electrophotographic photoreceptor thus obtained was charged by rubbing the surface layer thereof with a 0.5-mm thick steel blade having a sharpened tip across which a DC voltage of +400 V was applied. The electrophotographic photoreceptor was then exposed and developed. The surface of the photoreceptor drum was maintained at a temperature of about 30° C. by means of a photoreceptor drum heater to effect transfer and fixing. Transfer and fixing were simultaneously effected by pressing a transfer roll made of polyvinyl acetal against the photoreceptor drum under a pressure of 200 $kg/cm^2$ with a transfer paper inserted therebetween. This provided an image having the same fixing quality as obtained by heat fixing.

No defective cleaning and charging occurred.

EXAMPLE 5

A copying operation was effected on the same photoreceptor as used in Example 4 by means of the same copying machine as used in Example 4 in the same manner as in Example 4 except that the capsule toner was rendered electrically conductive by adding 1 part by weight of carbon black. In this operation, the potential required for development was 100 V. Thus, an image was thoroughly transferred and fixed under pressure. The resulting fixing quality was the same as obtained by heat fixing.

EXAMPLE 6

With a capsule toner prepared in Example 4, a copying operation was effected on the same photoreceptor as used in Example 4 by means of the same copying machine as used in Example 4, except that the metallic charger used was a steel blade covered with an amorphous carbon film on the portion which comes into contact with the electrophotographic photoreceptor. The formation of the amorphous carbon film on the blade was accomplished by a process which comprises evacuating a vacuum tank in which the blade had been placed, introducing a mixture of hydrogen gas and ethylene gas into the vacuum tank, and then subjecting to glow discharge decomposition by microwave. Thus, an amorphous carbon film having a thickness of 1 μm and a Vickers hardness of 3,000 $Kg/mm^2$ was formed.

The conditions under which the film was formed are as follows:

Flow rate of 100% hydrogen gas: 180 $cm^3$/min.

Flow rate of 100% ethylene gas: 30 $cm^3$/min.

Inner pressure of reaction vessel: 0.5 Torr

Discharge power: 500 W

Microwave frequency: 2.45 GHz

A copying operation was effected in the same manner as in Example 4 wherein a capsule toner was used. The resulting image exhibited the same fixing property as obtained by heat fixing. The photoreceptor showed no toner left on the surface thereof and a percent transfer of 99.5%. The repeating of copying operation caused no toner adherence. Further, no defective charging occurred.

EXAMPLE 7

An amorphous carbon film was formed instead of the surface layer in Example 4. The conditions under which the surface layer was formed are as follows:

Flow rate of 100% hydrogen gas: 180 $cm^3$/min.

Flow rate of 100% ethylene gas: 36 $cm^3$/min.

Inner pressure of reaction vessel: 0.5 Torr

Discharge power: 50 W

Discharge time: 40 min.

A printing operation was effected on the photoreceptor thus obtained in the same manner as in Example 6. The resulting image was sharp. The photoreceptor showed no toner attached to the surface thereof and no uneven charging.

According to the preferred embodiment of the present invention, the photoreceptor is charged while being brought into contact with a blade-shaped metallic charger and developed with toner particles, and transfer and fixing of a toner image thus developed are simultaneously effected under pressure. This enables miniaturization of copying machine as well as energy saving. This also eliminates the need for maintenance. Further, a high quality print can be obtained free of image blur even under high humidity conditions. Moreover, if a capsule toner is used as a toner, transfer and fixing can be effected under a low fixing pressure, eliminating disadvantages such as occurrence of toner filming on the surface of the photoreceptor and insufficient transfer and fixing.

While the invention has been described in detail and with reference to specific embodiments thereof, it will be apparent to one skilled in the art that various changes and modifications can be made therein without departing from the spirit and scope thereof.

What is claimed is:

1. A process for the formation of an image, which comprises:

bringing a metallic charger into contact with the surface of an amorphous silicon photoreceptor, wherein the metallic charger is coated with amorphous silicon or amorphous carbon at at least the portion of the charger brought into contact with the surface of the photoreceptor;

providing a potential difference between said amorphous silicon photoreceptor and said metallic charger to charge said photoreceptor;

exposing said photoreceptor to light to form an electrostatic latent image;

developing said electrostatic latent image to cause toner particles to be attached to the surface of said photoreceptor;

superimposing a transfer medium on the surface of said photoreceptor; and transferring the toner particles to said transfer medium.

2. The process according to claim 1, further comprising a step of removing the residual toner particles from the surface of said photoreceptor by means of said metallic charger.

3. The process according to claim 1, wherein the toner particles are transferred and fixed simultaneously to said transfer medium.

4. The process according to claim 1, wherein said toner particles are capsule type toner particles comprising a core and a shell.

5. The process according to claim 1, wherein said metallic charger is a metallic blade.

6. The process according to claim 1, wherein said amorphous silicon or amorphous carbon portion contains at least one of hydrogen and a halogen atom and at least one element selected from the group consisting of carbon, nitrogen, oxygen, the Group III elements and the Group V elements.

7. The process according to claim 1, wherein said amorphous silicon photoreceptor comprises an electrically conductive substrate having thereon, in sequence, an amorphous silicon photoconductive layer, an amorphous silicon interlayer, and an amorphous silicon surface layer.

8. The process according to claim 7, wherein a first electric charge injection-inhibiting layer is interposed between said photoconductive layer and said electrically conductive substrate.

9. The process according to claim 8, wherein said first electric charge injection-inhibiting layer comprises an amorphous silicon containing the Group III or V elements.

10. The process according to claim 7, wherein a second electric charge injection-inhibiting layer is interposed between said photoconductive layer and said interlayer.

11. The process according to claim 10, wherein said second electric charge injection-inhibiting layer comprises an amorphous silicon containing the Group III or V elements.

12. The process according to claim 7, wherein said amorphous silicon photoconductive layer comprises an amorphous silicon containing hydrogen or halogen atom and an impurity for controlling the electrical conductivity thereof.

13. The process according to claim 7, wherein said amorphous silicon interlayer contains hydrogen or halogen atom and one or more elements selected from the group consisting of nitrogen, carbon and oxygen.

14. The process according to claim 13, wherein the atomic ratio of said one or more elements to silicon becomes higher toward the surface layer.

15. The process according to claim 7, wherein said amorphous silicon surface layer contains hydrogen or halogen atom and one or more elements selected from the group consisting of nitrogen, carbon and oxygen.

16. The process according to claim 1, wherein said amorphous silicon photoreceptor comprises an electrically conductive substrate having provided thereon, in sequence, an amorphous silicon photoconductive layer, an electric charge trap layer, and an electric charge injection layer for injecting electric charge provided by said metallic charger.

17. The process according to claim 16, wherein an electric charge injection-inhibiting layer is interposed between said electrically conductive substrate and said amorphous silicon photoconductive layer.

18. The process according to claim 17, wherein said electric charge injection-inhibiting layer comprises an amorphous silicon or amorphous carbon containing the Group III or V elements.

19. The process according to claim 18, wherein said electric charge injection-inhibiting layer further contains at least one element selected from the group consisting of oxygen, nitrogen and carbon.

20. The process according to claim 16, wherein said electric charge injection layer comprises an amorphous silicon or amorphous carbon containing the Group III elements and said electric charge trap layer contains at least one element selected from the group consisting of carbon, nitrogen, oxygen and the Group V elements.

21. The process according to claim 16, wherein said electric charge injection layer comprises an amorphous silicon or amorphous carbon containing the Group V elements and said electric charge trap layer contains at least one element selected from the group consisting of carbon, nitrogen, oxygen and the Group III elements.

22. The process according to claim 1, wherein the metallic charger comprises a charging blade consisting essentially of metal.

* * * * *